United States Patent [19]

Leppo

[11] Patent Number: 5,002,181

[45] Date of Patent: Mar. 26, 1991

[54] CHAINLETTER APPARATUS

[76] Inventor: Ida J. Leppo, 19620 Beallsville Rd., Beallsville, Md. 20839

[21] Appl. No.: 468,455

[22] Filed: Jan. 22, 1990

[51] Int. Cl.[5] ..... B65D 85/62; G09F 7/00

[52] U.S. Cl. ..... 206/45.14; 40/124.1; 40/312; 206/459; 283/98

[58] Field of Search ..... 40/124.1, 152.1, 312, 40/313, 617; 206/44 R, 216, 232, 425, 449, 450, 459, 45.14; 283/98, 117; 434/96; 446/75, 148

[56] References Cited

U.S. PATENT DOCUMENTS

| | | | |
|---|---|---|---|
| 901,357 | 10/1908 | Lewis | 206/216 |
| 2,404,089 | 7/1946 | Pollock | 446/148 |
| 2,790,587 | 4/1957 | Contant | 40/312 |
| 2,824,394 | 2/1958 | Lohnes | 40/124.1 |
| 4,363,081 | 12/1982 | Wilbur | 206/232 |
| 4,538,730 | 9/1985 | Wu | 206/425 |

FOREIGN PATENT DOCUMENTS

| | | | |
|---|---|---|---|
| 2516720 | 10/1976 | Fed. Rep. of Germany | 206/232 |
| 0002645 | 9/1890 | Switzerland | 40/124.1 |

*Primary Examiner*—Jimmy G. Foster
*Attorney, Agent, or Firm*—David B. Newman, Jr. & Associates

[57] ABSTRACT

A chain letter apparatus comprising a container, a lid, a plurality of flat members approximately rectangular in shape, a plurality of links, and first and second set of chains. The lid covers the container. The first plurality of flat members may be rectangular in shape and have two holes at each end. The first plurality of flat members are positioned in an end-to-end contiguous line. The first plurality of links connects the holes of two adjacent flat members of the first plurality of flat members. The first set of chains connects to an inside of the container and couples to the holes of the flat member at a first end of the end-to-end contiguous line. The second set of chains connects to an inside of the lid and couples to the holes of the flat member at the second end of the end-to-end contiguous line.

16 Claims, 1 Drawing Sheet

CHAINLETTER APPARATUS

BACKGROUND OF THE INVENTION

This invention relates to an article of manufacture comprising a chainletter apparatus, and more particularly to an apparatus having a plurality of flat members for displaying letters or the like.

OBJECTS AND SUMMARY OF THE INVENTION

An object of the present invention is to provide a chainletter apparatus for displaying letters on flat members.

Another object of the present invention is to provide a chainletter apparatus that may be used for gifts and entertainment.

According to the present invention, as embodied and broadly described herein, a chainletter apparatus is provided comprising a container, a lid, a first plurality of flat members, first connecting means, first coupling means, and second coupling means. The first connecting means may be embodied as a first plurality of links, the first coupling may be embodied as a first set of chains, and the second coupling means may be embodied as a second set of chains. The lid is for covering the container. The first plurality of flat members may be approximately rectangular in shape, and have two holes at each end. The first plurality of flat members are positioned in an end-to-end contiguous line. The first plurality of links connects the holes of two adjacent flat members of the first plurality of flat members. The first set of chains connects to an inside of the container, and couples to the holes of the flat member at a first end of the end-to-end contiguous line. The second set of chains connects to an inside of the lid and couples to the holes of the flat member at the second end of the end-to-end contiguous line.

Additional objects and advantages of the invention will be set forth in the description as follows, and in part will be obvious from the description, or may be learned by practice of the invention.

BRIEF DESCRIPTION OF THE DRAWING

The accompanying drawing, which is incorporated in and constitutes a part of this specification, illustrates a preferred embodiment of the invention, and together with the description, serves to explain the principles of the invention.

DETAILED DESCRIPTION OF THE PREFERRED EMBODIMENTS

Figure 1:
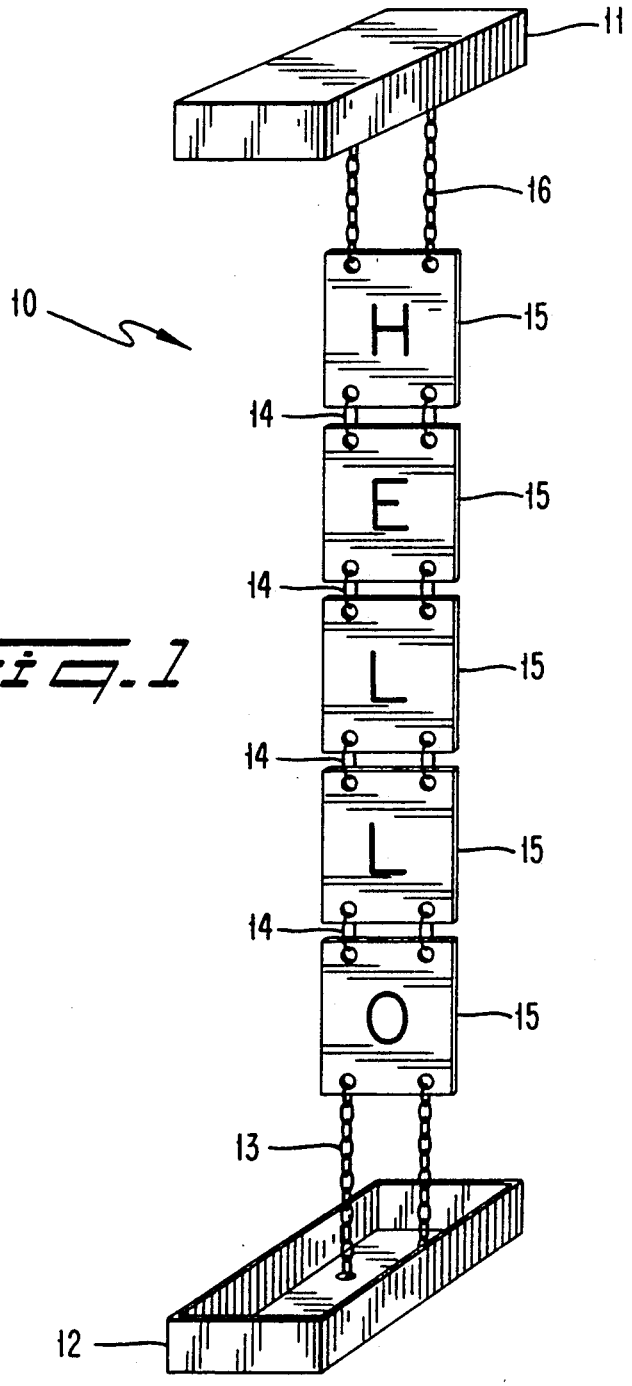
FIG. 1 illustrates a preferred embodiment of a chainletter apparatus according to the present invention

Reference will now be made to the present preferred embodiments of the present invention, examples of which are illustrated in the accompanying drawing.

Referring to FIG. 1, a preferred embodiment of a chainletter apparatus is shown comprising a container 12, a lid 11, a first plurality of flat members 15, first connecting means, first coupling means, and second coupling means. The first connecting means may be embodied as a first plurality of links 14. The first coupling means may be embodied as a first set of chains 13. The second coupling means may be embodied as a second set of chains 16. The lid 11 covers the container 12. The first plurality of flat members 15 may be approximately rectangular in shape and have two holes at each end. The first plurality of flat members 15 are positioned in an end-to-end contiguous line.

The first plurality of links 14 connects the holes of two adjacent flat members of the first plurality of flat members 15. The first set of chains 13 connects to an inside of the container 12 and couples to the holes of the flat member at a first end of the end-to-end contiguous line. The second set of chains 16 connects to an inside of the lid 11 and couples to the holes of the flat member at the second end of the end-to-end contiguous line.

The present invention may additionally include at least a second plurality flat members, a second plurality of links, and a third set of chains. The second plurality of flat members have two holes at each end, and are positioned in the end-to-end contiguous line. The second plurality of links connects to holes of two adjacent flat members of the second plurality of flat members. The third set of chains couples the second plurality of flat members between the first plurality of flat members and the lid 12.

The chainletter apparatus 10 as shown in FIG. 1 may be have the plurality of flat members 15 collapse inside the container 12 and have the lid 11 cover the container 12. Accordingly, flat members may fold in a zig-zag fashion until the flat members fit inside the container 12.

When the lid 11 is lifted from the container 12 the plurality of flat members 15 may extend in an end-to-end contiguous line, as shown in FIG. 1 and display a message. As shown the message HELLO may be painted on the flat members. Other messages may be used, or other decorative designs may be placed on the flat members 15.

Other shapes may be used to accomplish the same result as shown. For example, shapes other than rectangular may be used such as trapezoidal, oval, to accomplish the same result as that shown in FIG. 1. The links 14 are shown in a preferred embodiment, but other means may be used to couple adjacent flat members 15. Also, the first set of chains 13, and second set of chains 16 are shown, but other means may be used for connecting the lid 11 and container 12 to the first plurality of flat members.

The present invention has advantage that it is an entertaining way of sending a message to a friend, for example, for a birthday or holiday season. Several words may be used, having a first word on the first plurality of flat members, and second word on a second plurality of flat members, with the words separated by an additional set of chains to show a space between the words.

It will be apparent skilled in the art that various modifications can be made to the chainletter apparatus of the instant invention without departing from the scope or spirit of the invention, and it is intended that the present invention cover modifications and variations of the chainletter apparatus provided they come within the scope of the appended claims and their equivalents.

I claim:

1. A chain letter apparatus comprising:

a container;

a lid for covering said container;

a first plurality of flat members approximately rectangular in shape and having two holes at each end, and positioned in an end-to-end contiguous line;

a first plurality of links for connecting the holes of two adjacent flat members of said first plurality of flat members;

a first set of chains connecting an inside of said container and coupling to the holes of the flat member at a first end of the end-to-end contiguous line; and a second set of chains connecting to an inside of said lid and coupling to the holes of the flat member at the second end of the end-to-end contiguous line.

2. The chain letter apparatus as set forth in claim 1 further comprising:

at least a second plurality of flat members approximately rectangular in shape and having two holes at each end, and positioned in the end-to-end contiguous line;

at least a second plurality of links for connecting the holes of two adjacent flat members of said second plurality of flat members; and a third set of chains for coupling said second plurality of flat members between said first plurality of flat members and said lid.

3. A chain letter apparatus comprising:

a container;

a lid for covering said container;

a first plurality of flat members having holes at each end, and positioned in an end-to-end contiguous line;

a first plurality of links for connecting the holes of two adjacent flat members;

a first set of chains connecting to an inside of said container and coupling to the holes of the flat member at a first end of the end-to-end contiguous line; and a second set of chains connected to an inside of said lid and coupling to the holes of the flat member at the second end of the end-to-end contiguous line.

4. The chain letter apparatus as set forth in claim 3 further comprising:

at least a second plurality of flat members having two holes at each end, and positioned in the end-to-end contiguous line;

a least a second plurality of links for connecting the holes of two adjacent flat members of said second plurality of flat members; and a third set of chains for coupling said second plurality of flat members between said first plurality of flat members and said lid.

5. A chain letter apparatus comprising:

a container;

a lid for covering said container;

a first plurality of members positioned in an end-to-end contiguous line;

first means for connecting two respective adjacent members;

first means connected to an inside of said container for coupling to the member at a first end of the end-to-end contiguous line;

second means connected to an inside of said lid for coupling to the member at the second end of the end-to-end contiguous line; and wherein when said lid is lifted from said container the plurality of members may extend in an end-to-end contiguous line for displaying a message.

6. The chain letter apparatus as set forth in claim 5 further comprising:

at least a second plurality of members positioned in the end-to-end contiguous line;

second means for connecting two respective adjacent members; and third means for coupling said second plurality of members between said first plurality of members and said lid.

7. The chain letter apparatus as set forth in claim 6 wherein said second connecting means includes a plurality of links for connecting two respective adjacent members.

8. The chain letter apparatus as set forth in claim 5 wherein said first connecting means includes plurality of links for connecting two respective adjacent members.

9. The chain letter apparatus as set forth in claim 5 wherein said first coupling means includes a set of chains connecting to an inside of said container and coupling to the member at a first end of the end-to-end contiguous line.

10. The chain letter apparatus as set forth in claim 5 wherein said second coupling means includes a set of chains connecting to an inside of said lid and coupling to the member at a second end of the end-to-end contiguous line.

11. A chain letter apparatus comprising:

a container;

a lid for covering said container;

a first plurality of flat cards having holes at each end, positioned in an end-to-end contiguous line;

first means for connecting holes of respective adjacent flat cards of the first plurality of flat cards;

first means connected to an inside of said container for coupling to the flat cards at a first end of the end-to-end contiguous line; and second means connected to an inside of said lid for coupling to the flat cards at the second end of the end-to-end contiguous line.

12. The chain letter apparatus as set forth in claim 11 further comprising:

at least a second plurality of flat cards having holes at each end, positioned in the end-to-end contiguous line;

second means for connecting holes of respective adjacent flat cards of the second plurality of flat cards; and third means for coupling said second plurality of flat cards between said first plurality of flat cards and said lid.

13. The chain letter apparatus as set forth in claim 11 wherein said first connecting means includes a plurality of links for connecting two respective adjacent flat cards.

14. The chain letter apparatus as set forth in claim 11 wherein said first coupling means includes a set of chains connecting to an inside of said container for coupling to the flat card at a first end of the end-to-end contiguous line.

15. The chain letter apparatus as set forth in claim 11 wherein said second coupling means includes a set of chains connected to an inside of said lid for coupling to the flat card at a second end of the end-to-end contiguous line.

16. The chain letter apparatus as set forth in claim 12 wherein said second connecting means includes a plurality of links for connecting two respective adjacent flat cards.

* * * * *